US007508145B2

(12) United States Patent
Bourke et al.

(10) Patent No.: US 7,508,145 B2
(45) Date of Patent: Mar. 24, 2009

(54) MULTIPLE SIMULTANEOUS AISLE ACCESS CONTROL FOR A MOBILE STORAGE SYSTEM

(75) Inventors: Brian P. Bourke, Jefferson, WI (US); Matthew A. Tourdot, Whitewater, WI (US); William W. Lynt, III, Fort Atkinson, WI (US)

(73) Assignee: Spacesaver Corporation, Fort Atkinson, WI (US)

( * ) Notice: Subject to any disclaimer, the term of this patent is extended or adjusted under 35 U.S.C. 154(b) by 0 days.

(21) Appl. No.: 11/626,680

(22) Filed: Jan. 24, 2007

(65) Prior Publication Data

US 2007/0170824 A1 Jul. 26, 2007

Related U.S. Application Data

(60) Provisional application No. 60/761,936, filed on Jan. 25, 2006.

(51) Int. Cl.
*H02P 1/54* (2006.01)

(52) U.S. Cl. ..... 318/34; 312/198; 312/201

(58) Field of Classification Search ..... 318/34; 312/198, 199, 201

See application file for complete search history.

(56) References Cited

U.S. PATENT DOCUMENTS

| | | | | |
|---|---|---|---|---|
| 3,186,355 | A * | 6/1965 | Stoll et al. | 104/162 |
| 3,615,122 | A | 10/1971 | Naito et al. | |
| 3,923,354 | A * | 12/1975 | Young | 312/201 |
| 4,119,376 | A * | 10/1978 | Moyer | 312/198 |
| 4,412,772 | A * | 11/1983 | Naito et al. | 312/199 |
| 4,422,816 | A | 12/1983 | Naito et al. | |
| 4,783,618 | A | 11/1988 | Artrip | |
| 5,069,513 | A | 12/1991 | Farrell et al. | |
| 5,160,189 | A | 11/1992 | Johnston et al. | |
| 5,160,190 | A | 11/1992 | Farrell et al. | |
| 5,408,089 | A | 4/1995 | Bruno et al. | |
| 5,427,444 | A * | 6/1995 | Griesemer | 312/201 |
| 5,636,750 | A * | 6/1997 | Heyl | 211/1.57 |
| 5,842,585 | A * | 12/1998 | Hollander | 211/162 |

(Continued)

FOREIGN PATENT DOCUMENTS

GB 1348279 * 3/1974

(Continued)

*Primary Examiner*—Walter Benson
*Assistant Examiner*—Anthony M Paul
(74) *Attorney, Agent, or Firm*—Boyle Fredrickson, S.C.

(57) ABSTRACT

A mobile storage system includes movable storage units that can be positioned to selectively form an aisle between adjacent storage units. The storage units define a maximum aisle space that forms a single aisle between an adjacent pair of storage units, or a number of aisles between several adjacent pairs of storage units by distributing the maximum aisle space between at least two aisles. A control arrangement controls the position of the storage units, in response to user commands, so as to form the aisles. The control arrangement may be configured such that, when a pair of aisles are present between two pairs of storage units, one of the aisles is closed based on certain criteria when a command to open a different aisle is initiated. The criteria may be user defined, or may be a characteristic such as the frequency of use of the aisles such that the more frequently used aisle remains open and the less frequently used aisle is closed.

17 Claims, 6 Drawing Sheets

U.S. PATENT DOCUMENTS

| | | | | |
|---|---|---|---|---|
| 5,850,082 | A * | 12/1998 | Eaton et al. | 250/221 |
| 6,112,917 | A * | 9/2000 | Baker et al. | 211/162 |
| 7,032,762 | B2 * | 4/2006 | Miyazaki et al. | 211/162 |
| 2004/0226256 | A1 | 11/2004 | Miyazaki | |

FOREIGN PATENT DOCUMENTS

| | | |
|---|---|---|
| JP | 03212209 | 9/1991 |
| JP | 04090711 | 7/1995 |
| JP | 2003128211 | 5/2003 |

* cited by examiner

FIG. 1
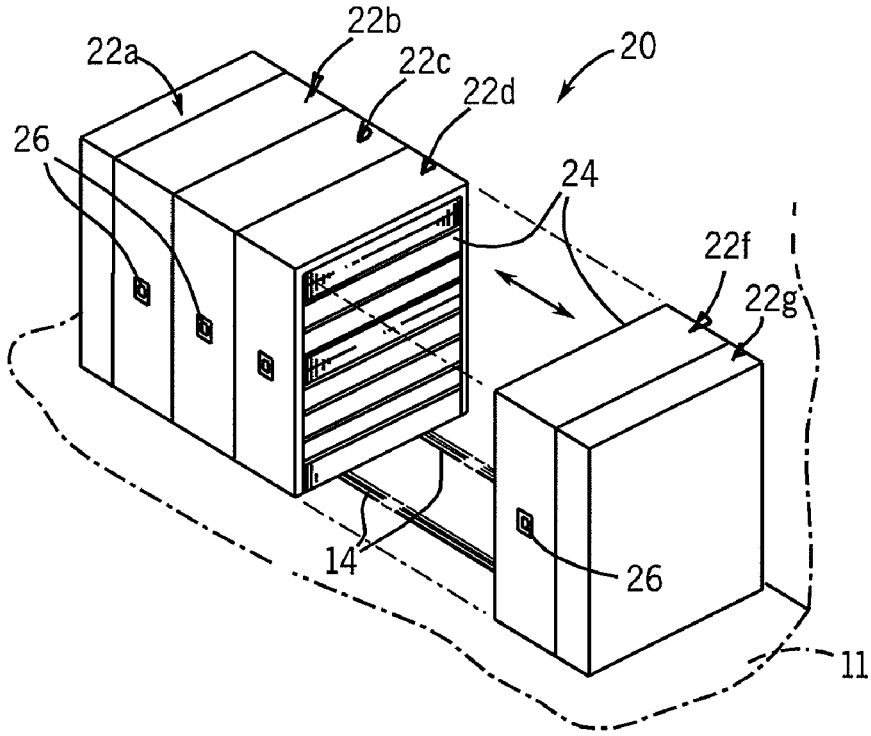
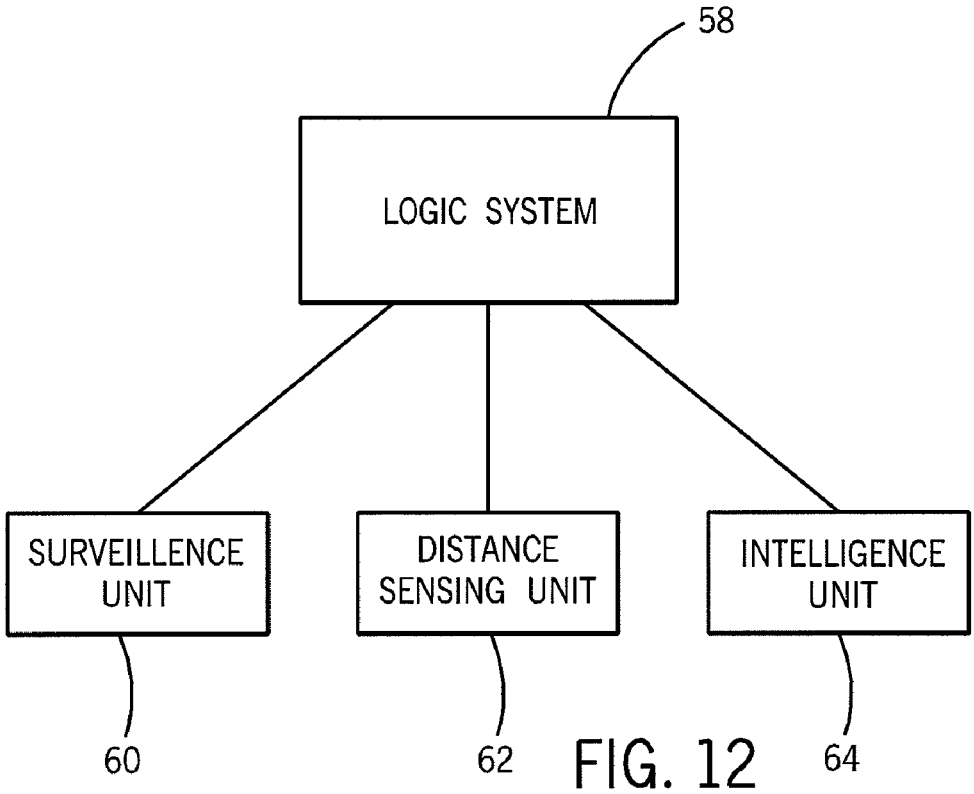
FIG. 12

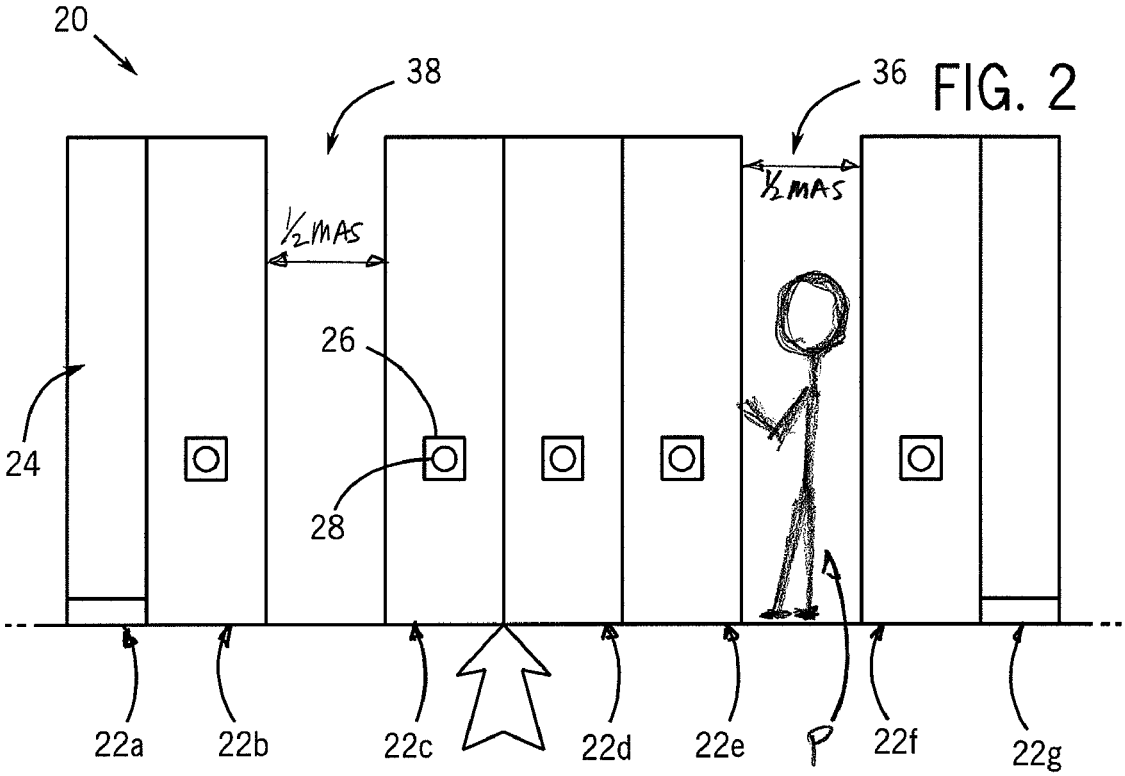
FIG. 2
FIG. 3
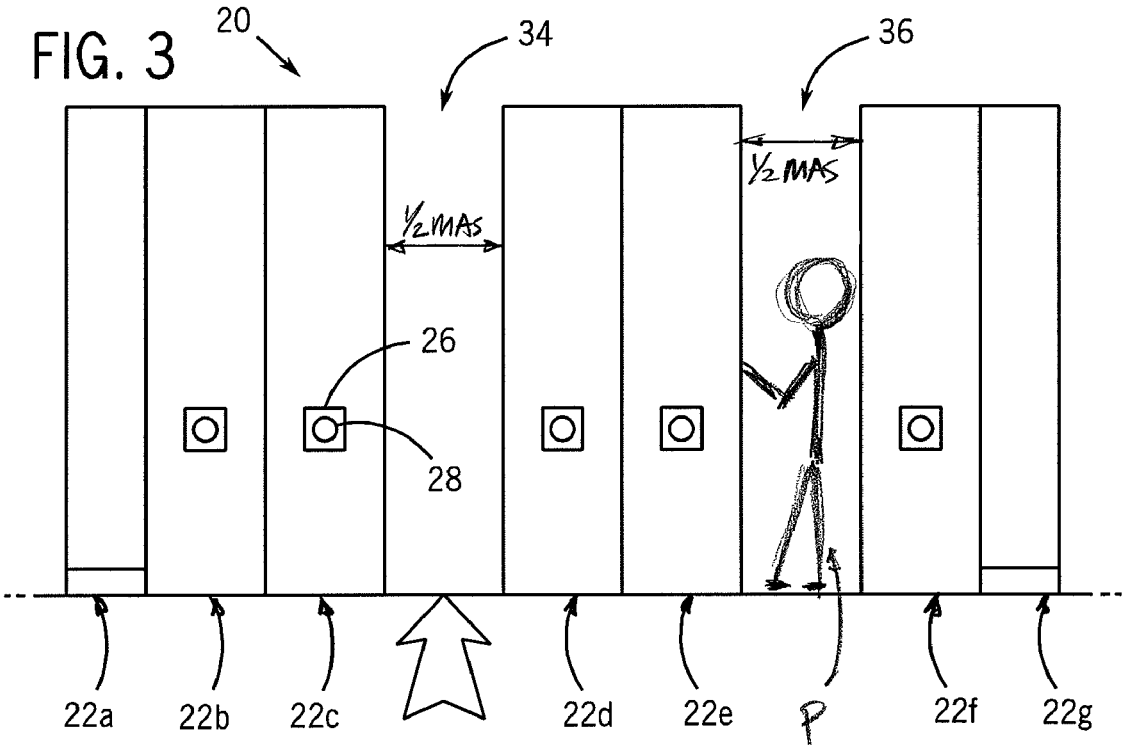

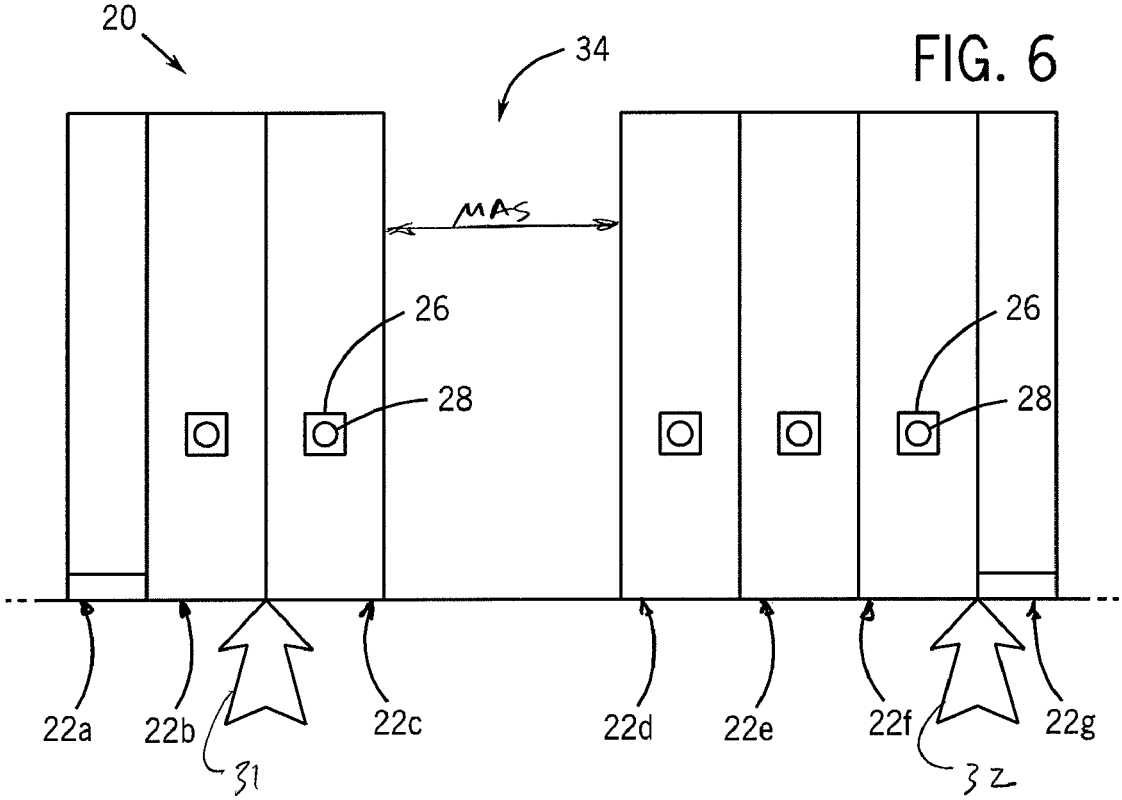
FIG. 6
FIG. 7
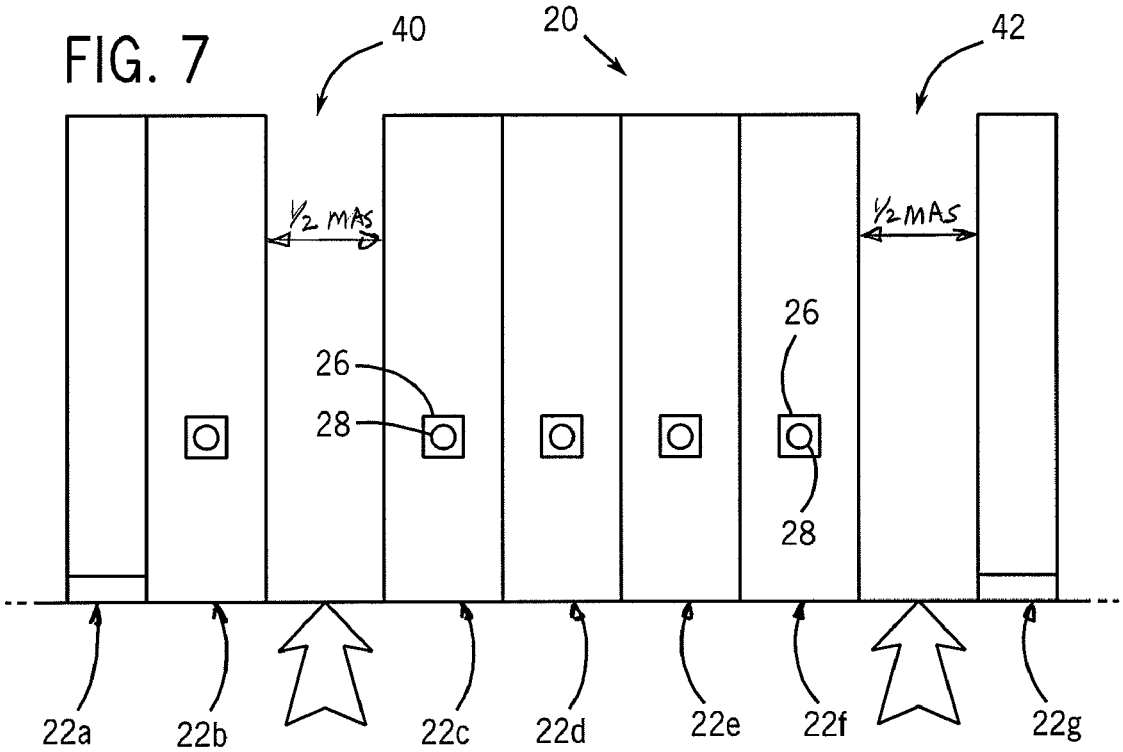

MULTIPLE SIMULTANEOUS AISLE ACCESS CONTROL FOR A MOBILE STORAGE SYSTEM

CROSS REFERENCE TO RELATED APPLICATION

This application claims the benefit of provisional patent application Ser. No. 60/761,936 filed Jan. 25, 2006.

BACKGROUND AND SUMMARY

This invention relates to a storage system, and more particularly a storage system of the type in which a series of movable storage units are selectively moved together and apart to form an aisle between adjacent storage units.

A mobile storage system typically consists of a number of storage units that are selectively movable relative to each other to form an aisle between an adjacent pair of storage units. The storage units are typically mounted to a pair of spaced apart rails, and each storage unit includes a carriage having wheels that are movable on the rails. Each storage unit includes a drive motor that is responsive to commands input from an operator, so as to provide movement of the storage unit on the rails. In the prior art, the number and spacing of the storage units are selected relative to the length of the rail such that a single aisle having a predetermined width can be created between any selected adjacent pair of storage units.

It is an object of the present invention to provide a mobile storage system that is configured and arranged to enable the storage units to be positioned such that a pair of aisles can be formed between two spaced apart sets of adjacent mobile storage units, in order to provide access to two different sets of storage units at any one time. It is a further object of the invention to provide a mobile storage system that enables the storage units to be positioned so as to provide a single, relatively wide aisle between an adjacent pair of storage units, so as to enable a relatively wide object to be positioned between the storage units, such as a wheelchair, a filing cart, etc. Yet another object of the invention is to provide such a storage system which is operable in response to certain criteria to maintain a certain aisle or aisles open when an operator wishes to create an aisle between a different pair of storage units.

In accordance with the present invention, a mobile storage system includes a number of mobile storage units that are movable toward and away from each other to selectively form an aisle between adjacent storage units. The storage units are arranged to define a maximum aisle space within the mobile storage system, which is capable of forming a single aisle between an adjacent pair of storage units or a number of aisles between several adjacent pairs of storage units. A control arrangement is operable to control the position of the storage units relative to each other, and is operable to position the storage units in response to user commands so as to form one or more aisles between the storage units. The control arrangement is operable to form either a single aisle between an adjacent pair of storage units using the maximum aisle space, or a number of aisles between a several adjacent pairs of storage units system by distributing the maximum aisle space between at least two aisles located between at least two adjacent pairs of mobile storage units.

The control arrangement may include a surveillance unit configured to monitor the presence of an object within the aisles, and is responsive to the surveillance unit to prevent movement of the storage units between which an aisle is located when an object is present in the aisle. In addition, each storage unit includes an actuator that is selectively operated by a user to cause relative movement between the storage unit and an adjacent storage unit to form an aisle therebetween. The actuators and the control arrangement may be configured such that, when each actuator is initially actuated, an aisle having a width less than the maximum aisle space is formed between the storage unit and an adjacent storage unit. When each actuator is subsequently actuated after the initial actuation, an aisle having a width equal to the maximum aisle space is formed between the storage unit and an adjacent storage unit.

The control arrangement may be configured such that, when creating an aisle between an adjacent pair of storage units when a pair of aisles are present between two other adjacent pairs of storage units, one of the aisles between the two other adjacent pairs of storage units is closed based on one or more predetermined criteria. The predetermined criteria may be a user defined designation, or may be a characteristic such as the frequency of use of the aisles such that the more frequently used aisle remains open and the less frequently used aisle is closed.

The invention also contemplates a method of operating a mobile storage system including a number of movable storage units, substantially in accordance with the foregoing summary.

Various other features, objects and advantages of the invention will be made apparent from the following detailed description taken together with the drawings.

BRIEF DESCRIPTION OF THE DRAWINGS

The drawings illustrate the best mode presently contemplated of carrying out the invention. In the drawings:

FIG. 1 is an isometric view of a mobile storage system incorporating the multiple simultaneous aisle access control in accordance with the present invention;

FIGS. 2-11 are side elevation views of the mobile storage system of FIG. 1, showing the storage units incorporated in the mobile storage system and the various movements of the storage units to form one or more aisles between adjacent storage units; and FIG. 12 is a schematic view of components incorporated in a controller forming a part of the mobile storage system of FIG. 1.

DETAILED DESCRIPTION

Figure 4:
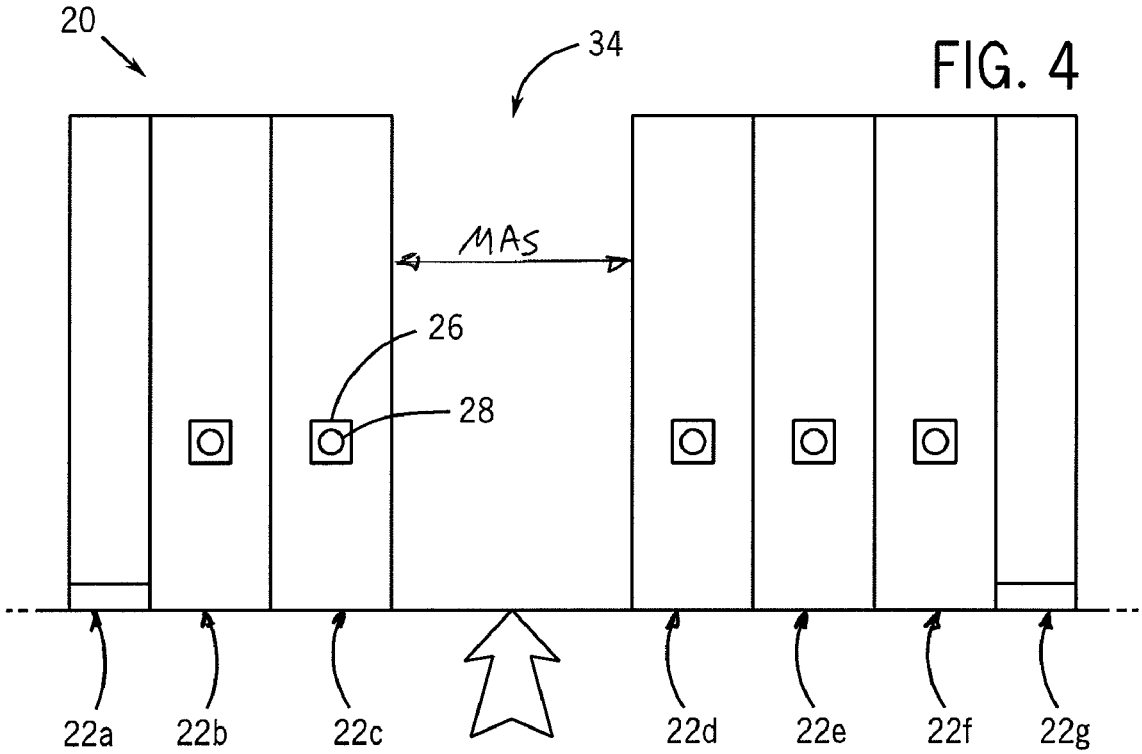

FIGS. 1-11 illustrate a mobile storage system 20 which includes a series of upright storage units 22*a-g*, each of which generally includes a shelf or cabinet 24 and a base assembly including an individually mobile carriage to which the shelf or cabinet 24 is mounted. Each cabinet 24 is mounted to its respective mobile carriage for lateral movement within the mobile storage system 20. Each storage unit 22*a-g* is movable along, for example, a set of rails 14 by a prime mover, such as an electric motor connected to a drive wheel which runs along at least one of the rails. In a manner as is known, a scissors-type pantograph (not shown) may extend between adjacent storage units 22*a-g* for routing power and communication cables to the components of mobile storage system 20. The general construction and operation of this type of mobile storage system is known in the art, and is available from Spacesaver Corporation of Fort Atkinson, Wis.

Each of the storage units 22*a-g* is arranged to move alternately and selectively to the left and right as depicted to establish at least one access aisle between the storage units 22*a-g* at the command of an operator. As shown in FIGS.

1-11, the storage units 22*a*-22*g* are arranged to move rectilinearly relative to each other to establish at least one access aisle between any two of the storage units 22*a*-22*g*. In one embodiment, end storage units 22*a* and 22*g* may be stationary. It should be understood at the outset that the improved mobile storage system 20 described herein is adapted for controlling a system that has fewer or more storage units than are depicted in FIGS. 1-11, and that the end storage units 22*a* and 22*g* may or may not be movable.

In the illustrated embodiment, storage units 22*b*-22*f* are generally identical in construction and operation. A typical storage unit 22*c* has an operator input controller, represented by the rectangle marked 26, which may be mounted on an end of the storage unit 26 or in any other satisfactory location. An open aisle push button switch 28 is included in the controller 26. Controller 26 may also include other features such as an emergency stop button (not shown), as well as indicia or lights indicating operation status. The open aisle push button switch 28 is actuated by an operator to initiate the aisle opening procedures discussed in greater detail below.

A variety of known safety mechanisms can be utilized with the mobile storage system. For example, the safety mechanism may be in the form of a sweep or safety switch bar for notifying the control system associated with the drive arrangement of each storage unit to stop motion of the storage unit if an obstacle or impediment to movement is encountered. Examples of safety mechanisms are illustrated in U.S. Pat. Nos. 4,743,078 and 4,733,923, the disclosures of which are hereby incorporated by reference. Alternatively, a photoelectric sweep disclosed in, for example, U.S. Pat. No. 5,121,975, the disclosure of which is hereby incorporated by reference, could be utilized. Another alternative includes a system as shown in U.S. Pat. No. 5,427,444, also incorporated by reference, which illustrates a directional detector that detects entry of an obstacle into the aisle and prevents movement until the obstacle is detected to have left the aisle. Still another alternative includes a system as shown in U.S. Pat. No. 6,707,028, also incorporated by reference, which illustrates an object detection system for use in detecting the presence of an object within a space that includes a pair of pivotable light emitter/receiver units located outwardly of each side of the space and a series of reflectors located outwardly of each side of the space.

FIGS. 2-11 illustrate a series of alternative positions of the storage units 22*a*-22*g* of mobile storage system 20 in accordance with the present invention. As noted above, at each end of mobile storage system 20, a stationary storage unit may be provided or the endmost movable storage unit may be located adjacent a wall or other stationary structure. When at least one of the mobile storage units 22*a*-22*g* is moved apart from an adjacent mobile storage unit 22*a*-22*g* or wall, an aisle or space is formed therebetween. The aisle provides access to the contents of the mobile storage units 22*a*-22*g* on either side of the aisle. Before an aisle is formed, an object detection system or surveillance unit 60 of logic system 58 (FIG. 12) according to the invention is employed so as to ensure there are no obstructions in the path of movement of mobile storage units 22*a*-22*g* before commencing operation of the motors associated with the storage units 22*a*-22*g* so as to move the mobile storage units 22*a*-22*g* as necessary to close an aisle. In addition, as described in greater detail below, when an aisle is to be formed, logic system 58 utilizes a distance sensing unit 62 and an intelligence unit 64 to monitor the distance between storage units 22*a*-22*g* and uses the information to determine how wide to open a single aisle, which aisles to open if individuals or objects are present in an existing aisle, as well as which aisles to open based on a determination of which aisles are most frequently used.

In accordance with the present invention, the controller of mobile storage system 20 is programmed to maintain a maximum aisle space (MAS). In one embodiment, the MAS is sixty inches, however, a variety of MAS widths may be maintained depending on the requirements of the system. The MAS may be divided in a variety of ways within the mobile storage system 20. For example, as illustrated in FIGS. 2 and 3, the MAS can be divided between two discrete aisles 36 and 38. Alternatively, as illustrated in FIG. 4, the MAS can be utilized to form a single widened aisle 34, which may, e.g., be used to provide wheelchair access or to accommodate equipment used to load or unload the storage units. In the illustrated embodiment, actuation of an open aisle button 28 on a mobile storage unit 22*a*-22*g* causes one or a number of adjacent individual storage units to move to form an aisle. Once an aisle is already open, actuation of open aisle button 28 a second time causes the aisle to open further and create an aisle with a width equal to the MAS.

A variety of representative operational sequences will be described in reference to FIGS. 1-11 illustrating the advantages of the mobile storage system 20. FIG. 2 illustrates mobile storage system 20 with aisles 36 and 38 open. As noted above, when two aisles are open, the MAS is divided equally among the two aisles. In the illustrated embodiment, aisles 36 and 38 may each have a width of about thirty inches. When an operator would like to open an aisle between mobile storage units 22*c* and 22*d*, the operator presses an open aisle push button switch 28 in the controller 26 located on mobile storage unit 22*c*. Once actuated, the logic system 58 of the mobile storage system 20 must make a "decision" based on a variety of factors. In the illustrated, as shown in FIG. 12, a safety or surveillance unit 60 of the mobile storage system 20 will perform a check and detect an empty aisle 38 as well as the presence or absence of an object, such as a person P, in open aisle 36. If an object is present in open aisle 36, the controller of mobile storage system 20 will initiate a movement such that aisle 36 will remain open and aisle 38 will be closed to form aisle 34, as illustrated in FIG. 3. Aisle 38 is closed and aisle 34 is opened by the movement of mobile storage unit 22*c* to a position adjacent mobile storage unit 22*b*. The distance sensing unit 62 will maintain a distance of thirty inches for aisles 34 and 36.

When aisle 36 is empty, it can be closed in a subsequent action, such as shown in FIG. 4. If, for example, an operator would like to further widen aisle 34 to create wheelchair access, the operator presses the same open aisle push button switch 28 in the controller 26 located on mobile storage unit 22*c*. Once actuated, the logic system 58 of the mobile storage system 20 must again make a "decision." In the illustrated embodiment, the safety or surveillance unit 60 of the mobile storage system 20 will detect that aisle 36 is empty. Therefore, the controller of mobile storage system 20 will initiate a movement causing mobile storage units 22*d* and 22*e* to move toward mobile storage unit 22*f* thereby closing aisle 36 and widening aisle 34 to a width equal to the MAS. The distance sensing unit 62 will maintain a width of sixty inches for aisle 34.

Figure 5:
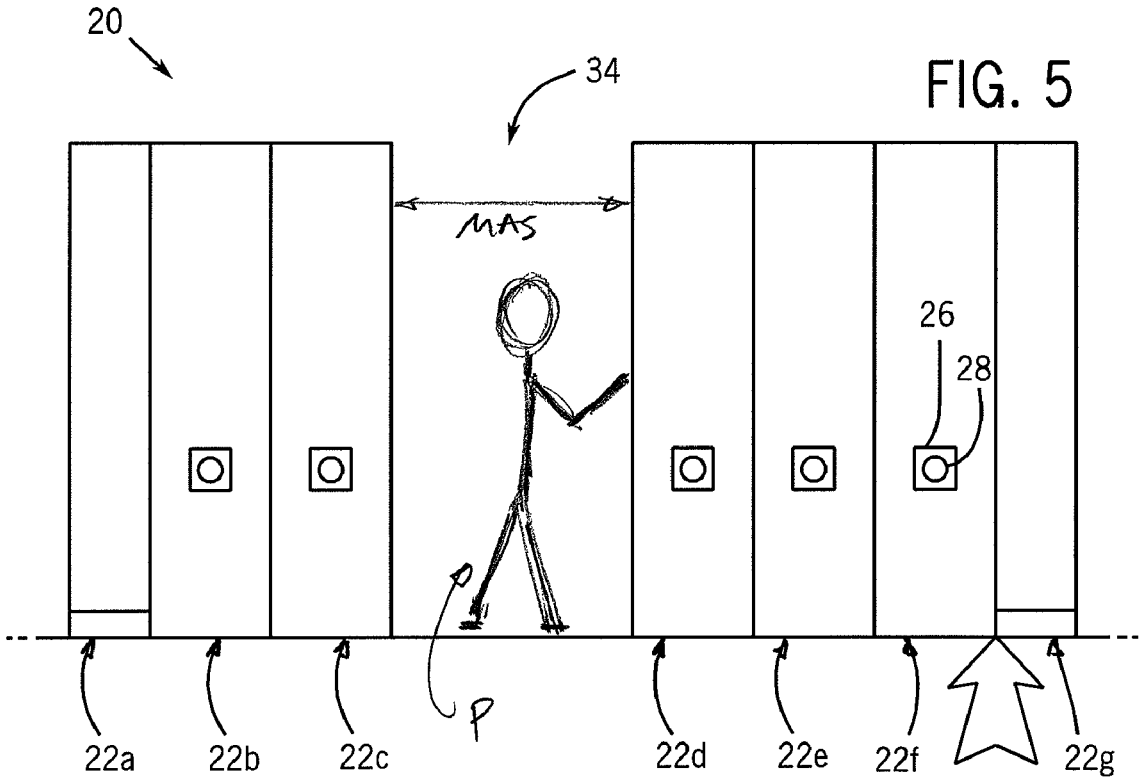

Turning now to FIG. 5, an obstacle, such as a person shown at P is present in the widened aisle 34. Therefore, if an operator desires to open another aisle, for example, between 22*f* and 22*g*, the controller of mobile storage system 20 will not complete this function. The distance sensing unit 62 will indicate that the MAS has been fully utilized and the safety or surveillance unit 60 will indicate the presence of the person 30 within the open aisle 34. A signal will be sent preventing any movement of the mobile storage units 22*c*, 22*d* adjacent the occupied aisle 34. As a result, upon actuation of an open aisle push button switch 28 in the controller 26 located on mobile storage unit 22*f*, the controller of mobile storage system 20 will generate a message indicating that the specified function cannot be performed. However, as illustrated in FIG. 6, once the person P has left aisle 34 and it is no longer occupied, aisle 34 can be closed in a subsequent action.

As illustrated in FIGS. 6 and 7, if a pair of operators would like to simultaneously open aisles between, for example, mobile storage units 22*b* and 22*c* and storage units 22*f* and 22*g*, as shown at open aisle requests 31 and 32, respectively, they would actuate the open aisle push button switches 28 in the controllers 26 located on mobile storage units 22*c* and 22*f*, respectively. Once actuated, the logic system 58 of the mobile storage system 20 must again make a "decision." The safety or surveillance unit 60 of the mobile storage system 20 will not detect the presence of an obstacle or object in open aisle 34. Therefore, system 20 will move mobile storage unit 22*c* as well as the group of storage units 22*d-f* in order to simultaneously form aisles 40 and 42 illustrated in FIG. 7. Aisle 34 is closed by the movement of mobile storage unit 22*c* as well as the group of storage 22*d-f*. The distance sensing unit 62 will split the MAS between the two aisles 40 and 42 such that each has a width of thirty inches. The operators now have access to aisles 40 and 42.

Figure 8:
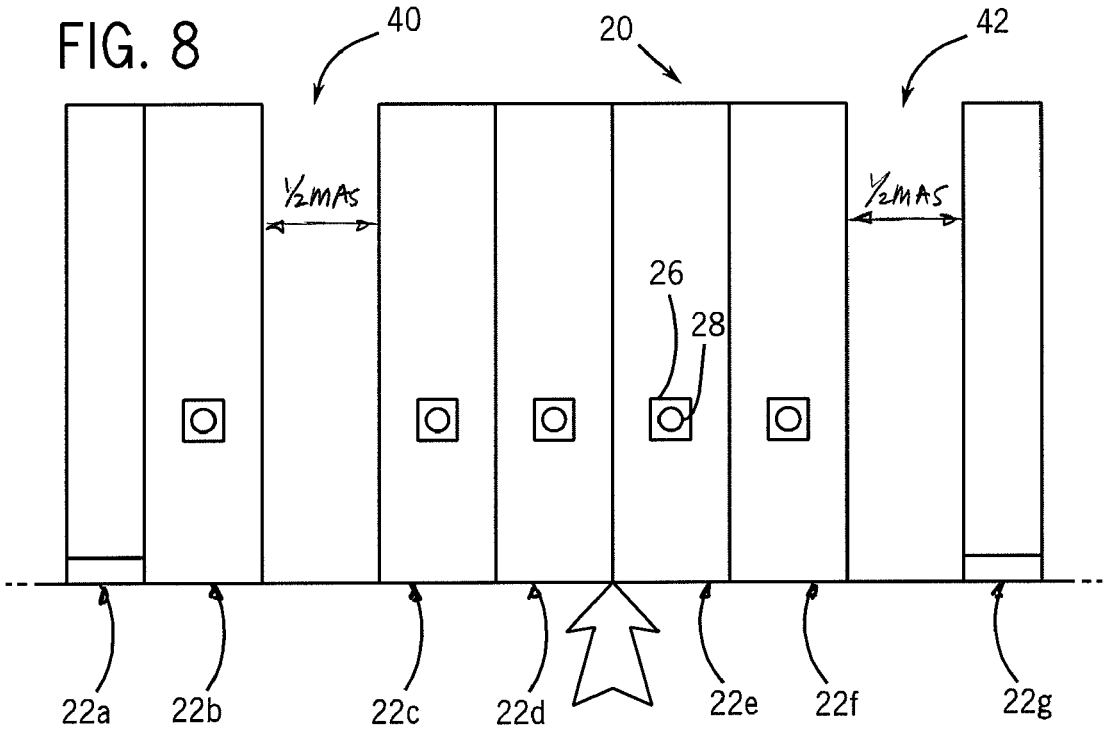
Figure 9:
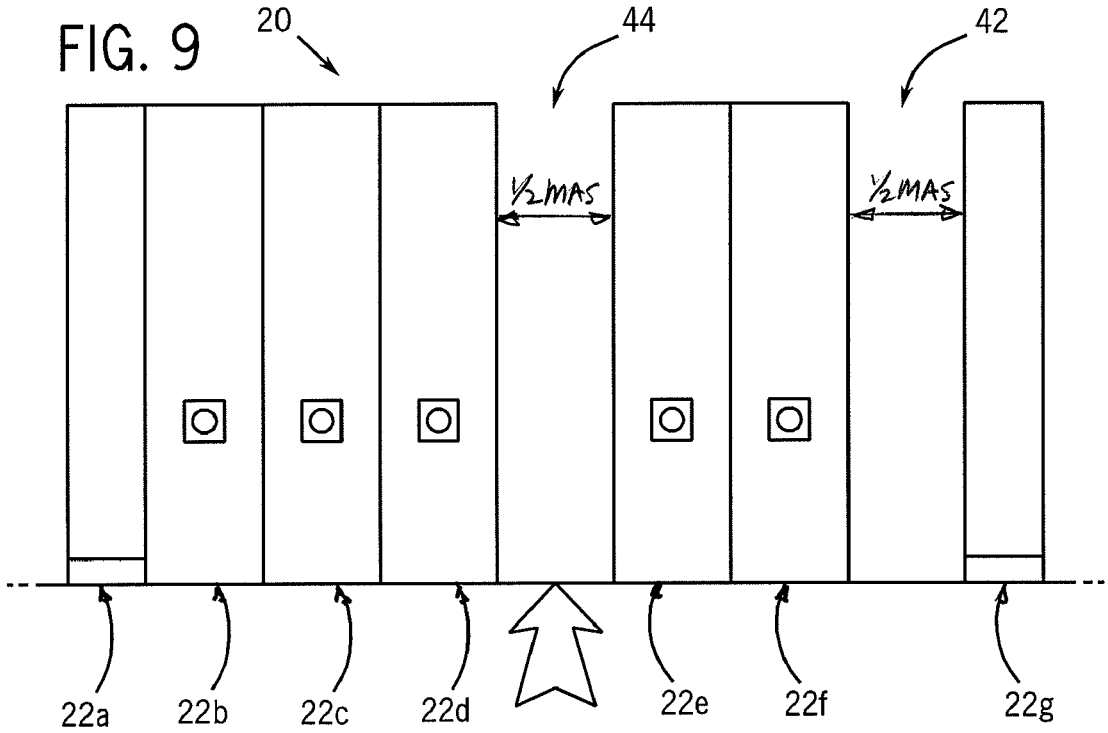

FIGS. 8 and 9 illustrate another unique feature of the mobile storage system 20, namely its ability to make "decisions" based on certain predetermined criteria, such as the frequency of use of a particular aisle. An intelligence unit 64 is included in the logic system 58 that maintains data regarding the frequency of use of a particular aisle. The frequency of use may be user defined, or may be determined on an ongoing basis by the intelligence unit 64 of logic system 58 based on information provided by the surveillance unit 60. Alternatively, the predetermined criteria may be a default that is programmed or input into the controller of mobile storage system 20 that instructs the logic system 58 to maintain a certain aisle open whenever possible.

As illustrated in FIG. 8, aisles 40 and 42 are both open and unoccupied, and a user desires to open an aisle between mobile storage units 22*d* and 22*e*. In the illustrated example, aisle 42 is more frequently used than aisle 40, or is the aisle that has been designated to remain open whenever possible. When the operator wishes to open an aisle between mobile storage units 22*d* and 22*e*, the operator presses an open aisle push button switch 28 in the controller 26 located on mobile storage unit 22*e*. Once actuated, the intelligence unit 64 of the logic system 58 of the mobile storage system 20 must make a "decision" regarding which aisle to close. Because the safety or surveillance unit 60 of the logic system 58 indicates that both aisles 40 and 42 are unoccupied, it bases its "decision" on the predetermined criteria, e.g. the frequency of use of the respective aisles 40 and 42. As noted above, aisle 42 is more frequently used than aisle 40. Therefore, aisle 42 will remain open and aisle 40 will be closed to form aisle 44 as illustrated in FIG. 9. Aisle 40 is closed by the movement of mobile storage units 22*c* and 22*d* and aisle 44 is opened. The distance sensing unit 62 will split the MAS between the two aisles 44 and 42 such that each has a width of thirty inches.

Figure 10:
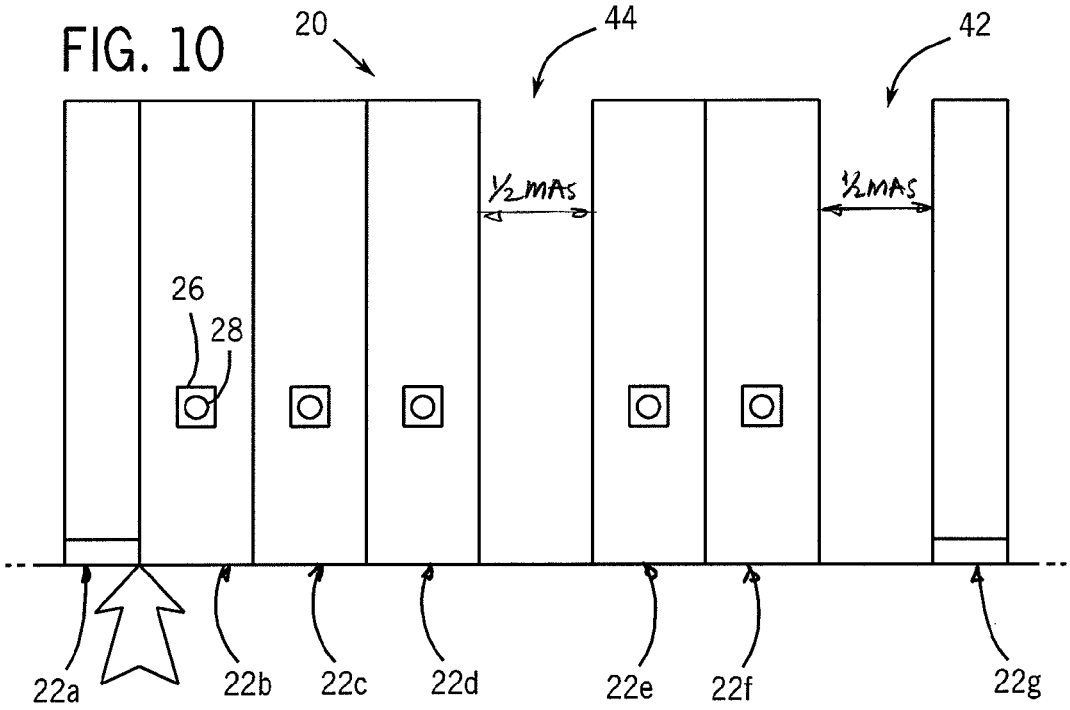
Figure 11:
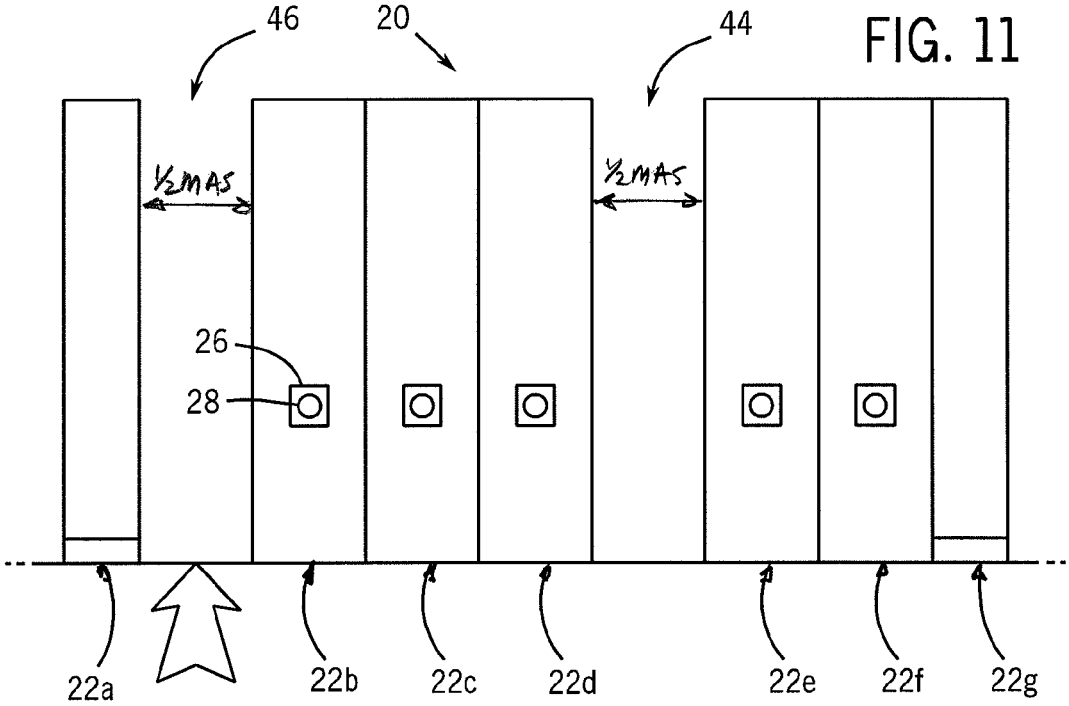

FIGS. 10 and 11 illustrate a similar example of the controller of mobile storage system 20, making a "decision" based on the predetermined criteria, e.g. frequency of use of a particular aisle. As illustrated in FIG. 10, aisles 44 and 42 are both open and unoccupied and a user desires to open an aisle between mobile storage units 22*a* and 22*b*. In the illustrated example, aisle 44 is either designated as the aisle to remain open when possible, or is more frequently used than aisle 42. Assuming an operator would like to open an aisle between mobile storage units 22*a* and 22*b*, the operator presses an open aisle push button switch 28 in the controller 26 located on mobile storage unit 22*b*. Once actuated, the intelligence unit 64 of the logic system of the mobile storage system 20 must make a "decision" regarding which aisle to close. Because the safety or surveillance unit 60 of the mobile storage system 20 indicates that both aisles 42 and 44 are unoccupied, it bases its "decision" on the predetermined criteria, e.g. frequency of use. As noted above, aisle 44 is more frequently used, therefore aisle 44 will remain open and aisle 42 will be closed to form aisle 46 illustrated in FIG. 11. Aisle 42 is closed by the movement of mobile storage units 22*e* and 22*f*. Aisle 46 is opened by the movement of mobile storage units 22*b-d*. Aisle 44 is maintained by the shifting of 22*b-d* and 22*e* and 22*f*. The distance sensing unit 62 will split the MAS between the two aisles 46 and 44 such that each has a width of thirty inches.

While this feature of the present invention has been shown and described with respect to certain predetermined criteria, e.g. user designation or frequency of use, it is understood that any other criteria may be employed and that the criteria may be altered or changed by the user if desired. For example, the predetermined criteria may be based on the contents of the storage units, the locations of the storage units within the floor plan of the space within which mobile storage system 20 is located, etc. When a frequency of use criteria is employed, the logic system 58 functions to compare the relative frequency of use of the two open aisles when a user wishes to create an aisle between another pair of adjacent storage units. It should also be understood that various criteria may be used in combination in order for the logic system 58 to determine which of a pair of open aisles to close when a user wishes to create an aisle between a pair of closed storage units.

It can thus be appreciated that the mobile storage system 20 provides for a mobile storage system capable of providing simultaneous access to multiple aisles within the storage system as well as generating a single widened aisle. The maximum aisle space can be divided between a single widened wheelchair accessible aisle, or two narrower aisles. The system monitors the presence of individuals or objects located within an aisle, the distance between aisles and the most frequently used aisles, in order to make "intelligent," safe decisions when opening or closing a particular aisle. As a result, system productivity and safety are increased. This is in contrast to mobile storage systems of the prior art, wherein the mobile storage units adjacent an open aisle are moved to close an aisle regardless of the frequency of use of the particular aisle.

While the system has been shown and described with respect to a specific embodiment, it is contemplated that certain details may vary from the specific construction as disclosed, while still falling within the scope of the present invention. Furthermore, the reference to "positions" throughout the application is for illustrative purposes and in no way limiting. Further, while the invention has been shown and described as having seven mobile storage units, it is understood that this number of mobile storage units is illustrative and that any other number of mobile storage units may be employed. Likewise, while the invention has been shown and described as having two narrower or one wide aisle any number of aisles could be generated within the system depending on the overall needs and use of the system.

Various alternatives and modifications are contemplated as being within the scope of the following claims, which particularly point out and distinctly claim the subject matter regarded as the invention.

We claim:

1. A mobile storage system, comprising:

a plurality of mobile storage units, wherein the mobile storage units are movable toward and away from each other to selectively form an aisle between adjacent storage units, wherein the storage units are arranged to define a maximum aisle space within the mobile storage system, and wherein the maximum aisle space is capable of forming a single aisle between an adjacent pair of storage units or a plurality of aisles between a plurality of adjacent pairs of storage units; and a control arrangement that is operable to control the position of the storage units relative to each other, wherein the control arrangement is operable to position the storage units in response to user commands so as to form one or more aisles between the storage units, wherein the control arrangement is operable to form either a single aisle between an adjacent pair of storage units using the maximum aisle space, or a plurality of aisles between a plurality of adjacent pairs of storage units system by distributing the maximum aisle space between at least two aisles located between at least two adjacent pairs of mobile storage units;

wherein each storage unit defines an end that includes an actuator, wherein the actuator of each storage unit is selectively operated by a user to cause relative movement between the storage unit and an adjacent storage unit to form an aisle therebetween, and wherein the actuators and the control arrangement are configured such that, when each actuator is initially actuated, an aisle having a width less than the maximum aisle space is formed between the storage unit and an adjacent storage unit, and when each actuator is subsequently actuated after the initial actuation, an aisle having a width equal to the maximum aisle space is formed between the storage unit and an adjacent storage unit.

2. A mobile storage system, comprising:

a plurality of mobile storage units, wherein the mobile storage units are movable toward and away from each other to selectively form an aisle between adjacent storage units, wherein the storage units are arranged to define a maximum aisle space within the mobile storage system, and wherein the maximum aisle space is capable of forming a single aisle between an adjacent pair of storage units or a plurality of aisles between a plurality of adjacent pairs of storage units; and a control arrangement that is operable to control the position of the storage units relative to each other, wherein the control arrangement is operable to position the storage units in response to user commands so as to form one or more aisles between the storage units, wherein the control arrangement is operable to form either a single aisle between an adjacent pair of storage units using the maximum aisle space, or a plurality of aisles between a plurality of adjacent pairs of storage units system by distributing the maximum aisle space between at least two aisles located between at least two adjacent pairs of mobile storage units, and wherein the control arrangement is configured such that, when creating an aisle between an adjacent pair of storage units when a pair of aisles are present between two other adjacent pairs of storage units, one of the aisles between the two other adjacent pairs of storage units is closed based on one or more predetermined criteria.

3. The mobile storage system of claim 2, wherein the control arrangement further comprises a surveillance unit configured to monitor the presence of an object within the aisles, and wherein the control arrangement is responsive to the surveillance unit to prevent movement of the storage units between which an aisle is located when an object is present in the aisle.

4. The mobile storage system of claim 2, wherein each storage unit defines an end that includes an actuator, wherein the actuator of each storage unit is selectively operated by a user to cause relative movement between the storage unit and an adjacent storage unit to form an aisle therebetween.

5. The mobile storage system of claim 2, wherein the predetermined criteria comprises the frequency of use of the aisles, wherein the more frequently used aisle remains open and the less frequently used aisle is closed.

6. The mobile storage system of claim 2, wherein the predetermined criteria comprises a user-defined designation of an aisle that is to remain open.

7. A mobile storage system, comprising:

a plurality of movable storage units defining at least one aisle between a pair of adjacent storage units, and wherein the movable storage units include a drive arrangement adapted to move the storage units to selectively form the aisle between adjacent storage units; and control means interconnected with the drive arrangement for distributing a maximum aisle space between either one aisle located between a single pair of storage units, or between a pair of aisles, wherein the pair of aisles is located between two spaced apart sets of adjacent storage units, wherein the control means is configured such that, when an operator desires to create an aisle between a pair of storage units, the control means is operable close one of a pair of open aisles based on predetermined criteria.

8. The mobile storage system of claim 7, wherein the predetermined criteria is programmed into the control means.

9. The mobile storage system of claim 7, wherein the predetermined criteria comprises relative frequency of use of the aisles.

10. The mobile storage system of claim 7, further comprising surveillance means for monitoring the presence of an object within the aisles, and wherein the control means is responsive to the surveillance means to prevent movement of the storage units between which an aisle is located when an object is present in the aisle.

11. The mobile storage system of claim 7, wherein each storage unit defines an end that includes actuator means that is selectively operated by a user for causing relative movement between the storage unit and an adjacent storage unit to form an aisle therebetween.

12. A mobile storage system, comprising:

a plurality of movable storage units defining at least one aisle between a pair of adjacent storage units, and wherein the movable storage units include a drive arrangement adapted to move the storage units to selectively form the aisle between adjacent storage units; and control means interconnected with the drive arrangement for distributing a maximum aisle space between either one aisle located between a single pair of storage units, or between a pair of aisles, wherein the pair of aisles is located between two spaced apart sets of adjacent storage units;

wherein each storage unit defines an end that includes actuator means that is selectively operated by a user for causing relative movement between the storage unit and an adjacent storage unit to form an aisle therebetween, and wherein the actuator means and the control means are configured such that, when each actuator means is initially actuated, an aisle having a width less than the maximum aisle space is formed between the storage unit and an adjacent storage unit, and when each actuator means is subsequently actuated after the initial actuation, an aisle having a width equal to the maximum aisle space is formed between the storage unit and an adjacent storage unit.

13. A method of operating a mobile storage system that includes a plurality of mobile storage units, wherein the mobile storage units are movable toward and away from each other to selectively form an aisle between adjacent storage units, comprising the acts of:

providing a maximum aisle space within the mobile storage system, wherein the maximum aisle space is capable of forming a single aisle between an adjacent pair of storage units or a plurality of aisles between a plurality of adjacent pairs of storage units; and controlling the position of the storage units relative to each other so as to form either one aisle located between a single pair of storage units using the maximum aisle space, or a pair of aisles located between two spaced apart sets of adjacent storage units by distributing the maximum aisle space between the pair of aisles;

wherein each storage unit includes an actuator, and including the act of selectively operating an actuator to cause relative movement between the storage unit and an adjacent storage unit to form an aisle therebetween, wherein when each actuator is initially actuated, an aisle having a width less than the maximum aisle space is formed between the storage unit and an adjacent storage unit, and wherein when each actuator is subsequently actuated after the initial actuation, an aisle having a width equal to the maximum aisle space is formed between the storage unit and an adjacent storage unit.

14. A method of operating a mobile storage system that includes a plurality of mobile storage units, wherein the mobile storage units are movable toward and away from each other to selectively form an aisle between adjacent storage units, comprising the acts of:

providing a maximum aisle space within the mobile storage system, wherein the maximum aisle space is capable of forming a single aisle between an adjacent pair of storage units or a plurality of aisles between a plurality of adjacent pairs of storage units; and controlling the position of the storage units relative to each other so as to form either one aisle located between a single pair of storage units using the maximum aisle space, or a pair of aisles located between two spaced apart sets of adjacent storage units by distributing the maximum aisle space between the pair of aisles;

wherein the act of creating an aisle between an adjacent pair of storage units, when a pair of aisles are present between two other adjacent pairs of storage units, is carried out based on one or more predetermined criteria.

15. The method of claim 14, further comprising the act of monitoring the presence of an object within the aisles, and controlling movement of the storage units so as to prevent movement of a pair of storage units between which an aisle is located when an object is present in the aisle.

16. The method of claim 14, wherein the predetermined criteria comprises the frequency of use of the aisles such that the more frequently used aisle remains open and the less frequently used aisle is closed.

17. The method of claim 14, wherein the predetermined criteria comprises a user-defined designation of an aisle that is to remain open.

* * * * *